United States Patent [19]

Freitag

[11] 4,200,964

[45] May 6, 1980

[54] GRAVE SITE COVER

[76] Inventor: Fred H. Freitag, 182 E. Mary La., Valley Cottage, N.Y. 10989

[21] Appl. No.: 17,471

[22] Filed: Mar. 5, 1979

[51] Int. Cl.[2] ..... E02D 19/00

[52] U.S. Cl. ..... 27/30

[58] Field of Search ..... 27/30, 1; 40/124.5

[56] References Cited

U.S. PATENT DOCUMENTS

| | | | |
|---|---|---|---|
| 1,686,048 | 10/1928 | Thompson | 27/30 |
| 2,788,597 | 4/1957 | Michel | 27/1 X |

FOREIGN PATENT DOCUMENTS

| | | | |
|---|---|---|---|
| 169444 | 11/1951 | Austria | 27/30 |
| 1189260 | 3/1959 | France | 27/30 |
| 324452 | 11/1957 | Switzerland | 27/30 |

*Primary Examiner*—John D. Yasko

*Attorney, Agent, or Firm*—Darby & Darby

[57] ABSTRACT

A cover for a grave site is disclosed. The cover is formed from an outer casing, an inner casing fitted into the outer casing and a transparent cover plate to seal one wall of the outer casing. A decorative medium may be provided in a space defined by the outer casing, the inner casing and the transparent cover plate, and the medium may be viewed through the transparent plate. Additionally, flanges extending outwardly from side walls of the outer casing may be used to anchor the cover in the ground.

7 Claims, 2 Drawing Figures

GRAVE SITE COVER

BACKGROUND OF THE INVENTION

This invention relates to covers for grave sites.

Grave sites require considerable maintenance in order to be kept in an attractive and dignified state. Usually they are planted with flowers, sodded or otherwise decorated to maintain their appearance. These services involve substantial labor, and hence considerable cost.

Grave site covers of the type contemplated by this invention have previously been proposed. For example, U.S. Pat. No. 1,686,048, which issued to A. W. Thompson on Sept. 1, 1927, teaches such a device. The grave cover of that patent contemplates the use of a glass sheet which is mounted on a band and pushed into the ground by means of spikes extending downwardly from the band. Pictures or other ornamentations may be placed in a pocket underneath the glass sheet. Although the spikes are intended to be mounted closely enough to prevent small animals from entering the grave, no provision is made for waterproofing the pocket. As a result, moisture is likely to form on the underside of the glass sheet, thereby preventing viewing through it and destroying the pictures or other ornamentations which may be present. Additionally, this cover has the disadvantage of not being securely anchored in the ground and therefore, being capable of removal or destruction by vandals.

Applicant is aware of other grave covers shown in the prior art, for example, U.S. Pat. Nos. 1,773,391; 2,263,087; 2,284,993; and 2,312,859, but these are believed to be even less pertinent that the one already discussed.

Accordingly, it is an object of the present invention to provide a grave cover which reduces the need for and expense of maintaining grave sites.

It is a further object of the present invention to provide a grave cover which maintains the grave in an attractive and dignified state.

It is a still further object of this invention to provide a grave cover which is firmly anchored into the ground.

These objects are accomplished in accordance with the invention by means of a grave site cover having an outer casing, an inner casing, and a transparent cover plate which forms one wall of the outer casing. A decorative medium may be enclosed within the space defined by these components. Flanges extend outwardly from side walls of the outer casing to anchor the cover in the ground.

Other objects and advantages of the present invention will become apparent by reading the detailed description of the invention in conjunction with the accompanying drawings, in which.

DETAILED DESCRIPTION OF THE INVENTION

Figure 1:
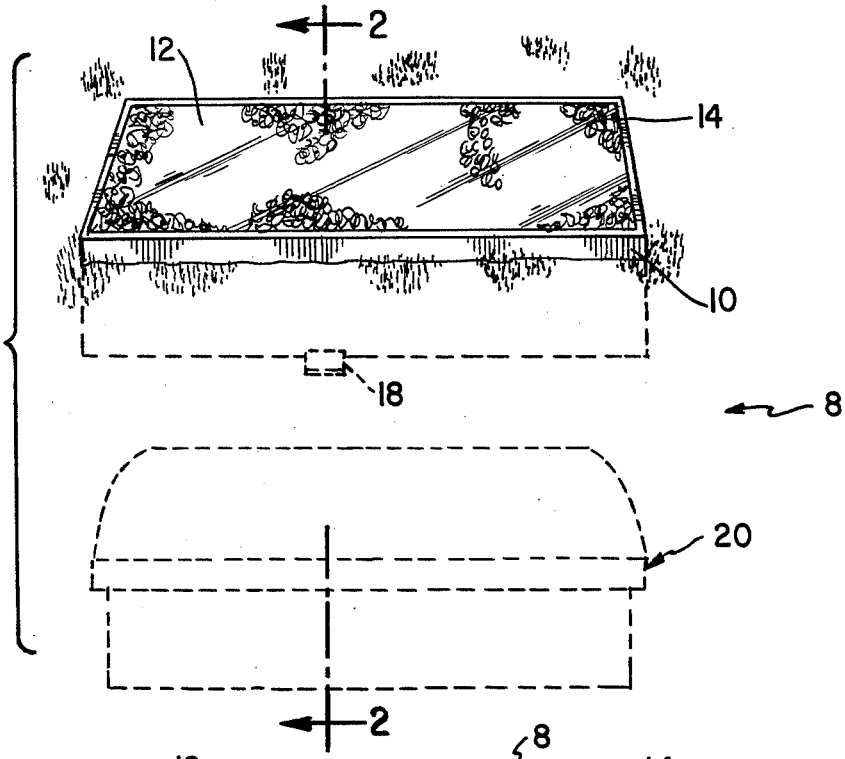
FIG. 1 is a top plan view of a grave cover in accordance with the invention.
Figure 2:
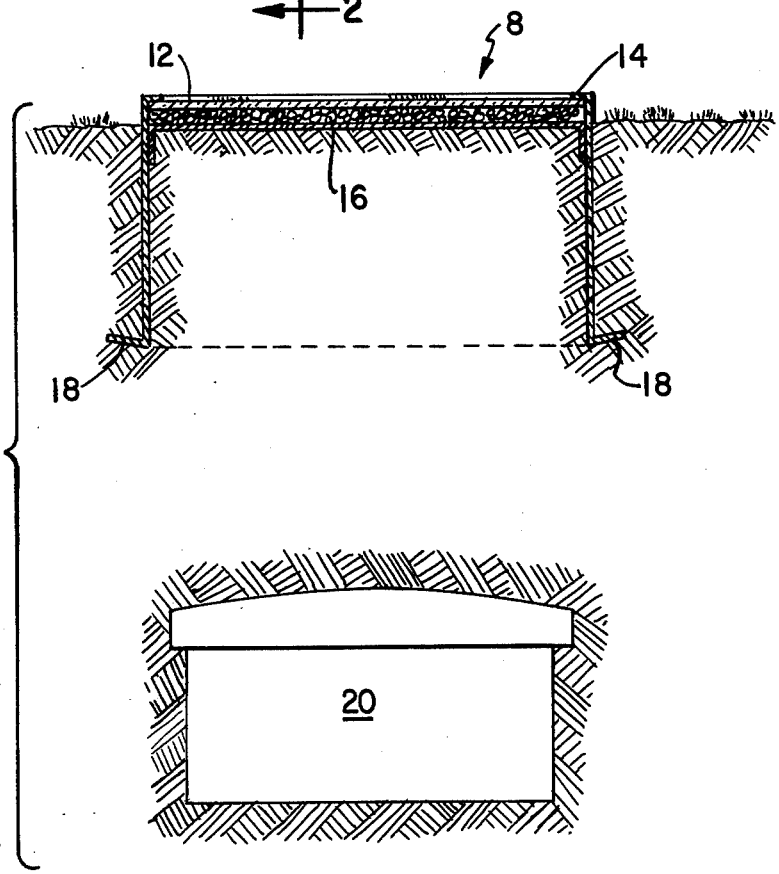
FIG. 2 is a side elevational view of a grave cover in accordance with the present invention taken along section line 2—2 of FIG. 1.

Referring to the drawings, FIGS. 1 and 2 show a grave site cover 8 in accordance with the present invention, which is designed to be fitted over casket 20. Cover 8 has as its main components outer casing 10, transparent plate 12, decorative medium 14, inner casing 16 (shown only in FIG. 2) and anchor 18.

Outer casing 10 has the form of a box which is open on each of two opposing sides. Along one open side, a rim extends inwardly towards the center of the box. Outer casing 10 may be made of any suitable material which is rigid and able to withstand the elements, but stainless steel has been found to be especially desirable.

Inner casing 16 also has the form of a box which is open on only one side. It too is preferably made of stainless steel.

Transparent plate 12 may be formed of any suitable material. However, glass is prone to breakage or chipping and such an occurrence would leave the grave in a less attractive and dignified state than might be desired. If glass is used, it should be of a sufficient thickness to avoid these problems as much as possible.

Because of the inherent disadvantages of glass, clear plastic is generally considered to be a more preferred medium. A hard plastic, which does not scratch readily is, of course, the most useful. Of such plastics, lexan has been found to have particularly desirable characteristics.

Use of a colored transparent plate is also contemplated by this invention.

Decorative medium 14 may be selected from any of an infinite variety of materials. Examples of such materials include colored decorative pebbles, white decorative pebbles or artificial grass. A grave marker could be included. Any other suitably sized statutes or ornaments could also be used and each medium may be used either alone or in combination with other mediums.

Flanges 18 extend outwardly from side walls of outer casing 10. One or more may be present.

In use, the decorative medium 14 is arranged on top of inner casing 16. Transparent plate 12 is laid on top of decorative medium 14. Outer casing 10 is then fitted over transparent plate 12, decorative medium and inner casing 16. The rim of outer casing 10 serves as a border for transparent plate 12 and decorative medium 14 may be viewed through transparent plate 12.

Inner casing 16 fits snugly into outer casing 10 and may be spot-welded to the outer casing in order to hold transparent plate 12 and decorative medium 14 in place. Provision may also be made for waterproofing the joint between transparent plate 12 and inner casing 16. This serves to prevent condensation on the inner surface of transparent plate 13 and the gradual destruction of decorative medium 14.

The entire pre-assembled unit 8 is installed at the grave site by being fitted over burial coffin 20. Only the upper portion of unit 8, about one to six inches, extends above ground level. Decorative medium 14 may be viewed through transparent plate 12. Flanges 18 serve as anchors to maintain the pre-assembled unit 8 in the ground.

Various changes and modifications may be made in the device without departing from the spirit or scope of the invention, and the above description is meant to be illustrative only.

What is claimed is:

1. A grave site cover comprising:

a substantially box-shaped rigid outer casing having a size and shape to fit over a casket;

a similarly sized and shaped inner casing adapted to fit snugly into said outer casing;

anchoring means extending outwardly from at least one side wall of said outer casing; and a transparent cover plate adapted to fit between said outer casing and said inner casing.

2. A grave site cover as defined in claim 1, wherein said anchoring means comprises two outwardly extending flanges mounted on opposing side walls of said outer casing.

3. A grave site cover as defined in claim 1, wherein said outer casing and said inner casing comprise stainless steel.

4. A grave site cover as defined in claim 1, wherein said transparent cover plate comprises clear plastic.

5. A grave site cover as defined in claim 1, further comprising a decorative medium enclosed within a space defined by said outer casing, said inner casing and said transparent cover sheet.

6. A grave site cover as defined in claim 5, wherein said decorative medium is selected from the group consisting of white decorative pebbles, colored decorative pebbles, artificial grass and a grave marker.

7. A grave site cover as defined in claim 5 wherein said cover is watertight.

* * * * *